United States Patent [19]

Paul

[11] Patent Number: 4,493,608

[45] Date of Patent: Jan. 15, 1985

[54] SURGE CONTROL IN COMPRESSOR

[75] Inventor: Duane B. Paul, Leominster, Mass.

[73] Assignee: General Electric Company, Lynn, Mass.

[21] Appl. No.: 453,535

[22] Filed: Dec. 27, 1982

[51] Int. Cl.[3] ..... F04D 27/02

[52] U.S. Cl. ..... 415/11; 415/1; 415/47; 415/17; 415/51

[58] Field of Search ..... 415/47, 1, 11, 17, 51

[56] References Cited

U.S. PATENT DOCUMENTS

| | | | |
|---|---|---|---|
| Re. 30,329 | 7/1980 | Rutshtein et al. | 415/1 |
| 3,292,846 | 12/1966 | Harper et al. | 415/11 X |
| 3,940,058 | 2/1976 | Norris | 415/1 X |
| 4,156,578 | 5/1979 | Agar et al. | 415/1 |
| 4,203,701 | 5/1980 | Abbey | 415/1 |
| 4,230,437 | 10/1980 | Bellinger et al. | 415/1 |
| 4,265,589 | 5/1981 | Watson et al. | 415/47 |
| 4,298,310 | 11/1981 | Blotenberg | 415/1 |
| 4,363,596 | 12/1982 | Watson et al. | 415/1 |
| 4,384,818 | 5/1983 | Blotenberg | 415/1 |

FOREIGN PATENT DOCUMENTS

| | | | |
|---|---|---|---|
| 1028345 | 5/1966 | United Kingdom | 415/47 |

*Primary Examiner*—Everette A. Powell, Jr.

*Attorney, Agent, or Firm*—James W. Mitchell

[57] ABSTRACT

A steam generation system employing a flash tank feeding low-pressure steam to a compressor controls surges in the compressor by calculating the amount of steam generated based on the temperature change and flow of water passing through the flash tank and modulates the flow rate in order to maintain the steam flow above a surge limit. If increasing the water flow rate is incapable of producing enough steam to avoid surges, a recycle control recycles steam from the output of the compressor back to the flash tank. A further embodiment of the invention permits using an auxiliary source of low-pressure steam to augment the steam produced in the flash tank while maintaining the total steam flow at a level sufficient to avoid surges. The steam flow may alternatively be derived from the differential pressure between outlet and inlet of the compressor.

8 Claims, 3 Drawing Figures

SURGE CONTROL IN COMPRESSOR

BACKGROUND OF THE INVENTION

Compressors provide a convenient means for compressing gas or steam for many applications. Such compressors may be subject to damaging oscillatory surges when operated under conditions of insufficient flow. If flow through such a compressor decreases below a critical value, herein known as a surge limit, flow momentarily reverses, returns to its original direction and continues oscillating back and forth due to the aerodynamics of such devices. Surge oscillation can produce violent vibration of the apparatus and, in some cases, can actually damage the apparatus.

Insufficiency of flow can occur due to two conditions: (1) insufficient supply; and (2) excessive differential pressure. If the process providing the steam or gas to the compressor is incapable of producing the amount required for smooth compressor operation, the supply limited condition exists. If the compressor feeds a discharge line at a pressure which is too much higher than the inlet pressure to produce the required flow, surge oscillations also result.

One method for controlling surges in a compressor includes the use of a blow-off valve on the outlet of the compressor to encourage adequate flow through the device. Blow-off valves are wasteful of energy since this energy is vented to the atmosphere.

As noted, the flow rate of steam or gas into a compressor is a critical surge parameter. However, the measurement of inlet flow, particularly for steam, is expensive and complicated. The expense is engendered due to the need for precise flow meters as well as by the fact that the measured flow must be corrected for changes in temperature and pressure of the steam.

One industrial application for a compressor includes compressing low-quality steam derived from hot water which is used, for example, as a collant in a primary industrial process. In one such application, hot water, typically below the boiling point, is admitted to a flash tank where the pressure is reduced by compressor suction to below the vapor pressure of water at that temperature. This permits steam to be driven off the water in the flash tank and the temperature of the water to be reduced. This steam is compressed and heated in the compressor and is supplied to a using process which may be, for example, a process heat exchanger, steam heating system, etc.

Slight changes in the inlet hot water flow rate to the flash tank or in the temperature of such water can significantly alter the flow rate of steam generated thereby and fed to the compressor. If the generated steam flow falls to the surge limit, compressor surges will ensue. In addition, if the using process reflects such excessive pressure back to the compressor that the differential pressure across the compressor reduces the flow which can be achieved below the surge limit, surges ensue.

OBJECTS AND SUMMARY OF THE INVENTION

Accordingly, it is an object of the invention to provide a surge control for a compressor which overcomes the drawbacks of the prior art.

It is a further object of the invention to provide a surge control for a compressor which does not require a blow-off valve to relieve outlet pressure for surge control.

It is a further object of the invention to provide a surge control for a compressor which employs a calculation of steam flow generated in the flash tank using inlet and outlet temperatures of water in the flash tank as well as water inlet flow to the flash tank.

It is a further object of the invention to control surges in a compressor fed by low quality steam from a flash tank by varying the water flow into the flash tank.

It is a further object of the invention to control surges in a compressor by recycling steam from its outlet back to its supply.

According to an aspect of the present invention, there is provided an apparatus for producing steam, comprising a flash tank, means for admitting a flow of hot water at a first temperature into the flash tank and for discharging water from the flash tank, a compressor having an inlet connected to the flash tank, the compressor being effective to reduce a pressure on the hot water in the flash tank to a value lower than a vapor pressure of water at the first temperature whereby a flow of steam is fed to the compressor and a temperature of water in the flash tank is reduced to a second temperature lower than the first temperature, means for calculating the flow of steam based on the first and second temperatures and the flow of hot water, and means for adjusting the means for admitting in response to the flow of steam to maintain an operating condition of the compressor in a normal region.

According to a feature of the present invention, there is provided an apparatus for producing steam, comprising a flash tank, means for admitting a flow of hot water at a first temperature into the flash tank and for discharging water from the flash tank, a compressor having an inlet connected to the flash tank, the compressor being effective to reduce a pressure on the hot water in the flash tank to a value lower than a vapor pressure of water at the first temperature whereby a flow of steam is fed to the compressor and a temperature of water in the flash tank is reduced to a second temperature lower than the first temperature, means for calculating the flow of steam based on the first and second temperatures and the flow of hot water, a recycle valve effective to recycle steam from downstream to upstream of the compressor, and means for opening the recycle valve in response to the flow of steam becoming less than a predetermined value thereby to maintain an operating condition of the compressor in a normal region.

According to a further feature of the present invention, there is provided an apparatus for producing steam, comprising a flash tank, means for admitting a flow of hot water at a first temperature into the flash tank and for discharging water from the flash tank, a compressor having an inlet connected to the flash tank, the compressor being effective to reduce a pressure on the hot water in the flash tank to a value lower than a vapor pressure of water at the first temperature whereby a flow of steam is fed to the compressor and a temperature of water in the flash tank is reduced to a second temperature lower than the first temperature, means for calculating the flow of steam based on a pressure rise across the compressor, and means for adjusting the means for admitting in response to the flow of steam to maintain an operating condition of the compressor in a normal region.

According to a still further feature of the present invention, there is provided a method for producing steam for a compressor, comprising admitting a flow of hot water at a first temperature into a flash tank and discharging water from the flash tank, reducing a pressure on the hot water in the flash tank with the compressor to a value lower than a vapor pressure of water at the first temperature whereby a flow of steam is fed to the compressor and a temperature of water in the flash tank is reduced to a second temperature lower than the first temperature, calculating the flow of steam based on the first and second temperatures and the flow of hot water, and adjusting the means for admitting in response to the flow of steam to maintain an operating condition of the compressor in a normal region.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
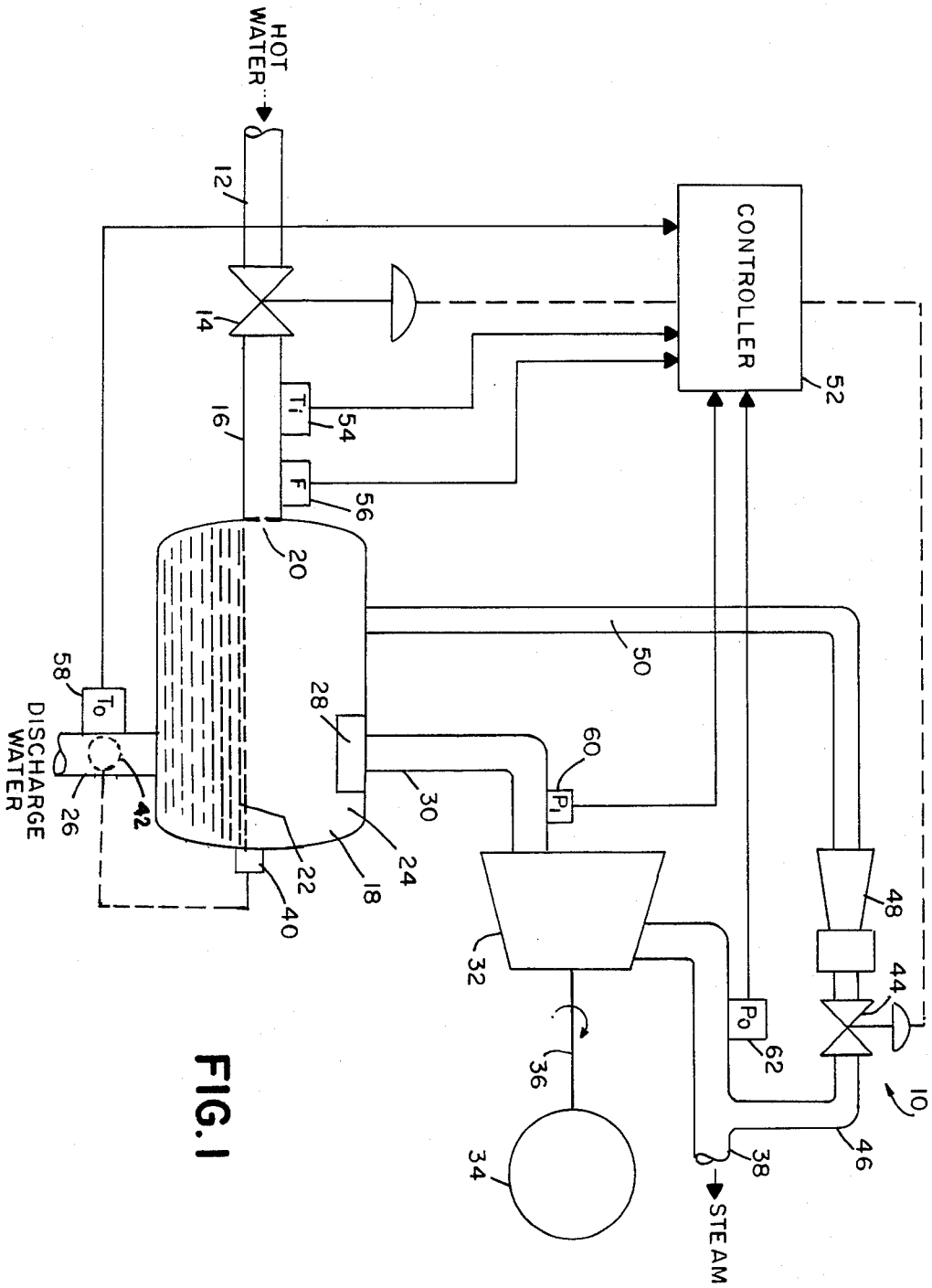
FIG. 1 is a simplified schematic diagram of a steam generation system including surge control according to an embodiment of the invention.

Referring now to FIG. 1, there is shown, generally at 10, a steam generation system according to an embodiment of the present invention. Hot water, preferably clean hot water, is applied on a conduit 12 to a hot water supply valve 14 which controls the amount of hot water fed through a conduit 16 to a flash tank 18. A throttling orifice 20 permits the pressure in flash tank 18 to be reduced substantially below the pressure in conduit 16. Liquid water 22 partially fills flash tank 18. An upper region 24 of flash tank 18 is filled with steam produced by the reduction of pressure below the vapor pressure of the hot water. Water is discharged from flash tank 18 on a discharge conduit 26. A droplet filter 28, or mist eliminator, removes liquid water droplets from the steam which is thereupon applied on a conduit 30 to an inlet of a compressor 32. A motor 34 drives compressor 32 via a mechanical connection 36 to compress the steam and increase its temperature for delivery on a conduit 38 to any suitable using facility.

A level sensor 40 senses the level of liquid water 22 in flash tank 18 and controls a pump 42 to maintain the liquid level with a predetermined range.

A recycle valve 44, connected to conduit 38 by a recycle conduit 46, is controlled as part of the surge control as will be explained. The outlet of recycle valve 44 is applied to a desuperheater 48 where the temperature of the steam is reduced to approximately the temperature of steam in flash tank 18 and the resulting cooled steam is returned to flash tank 18 on a conduit 50. Desuperheater 48 may be, for example, a heat exchanger for reducing the steam temperature. However, in the preferred embodiment, desuperheater 48 employs a supply of cool water injected into the steam for reducing its temperature.

A controller 52 receives measured parameters and, in response thereto, provides a mechanical control for hot water supply valve 14 and recycle valve 44. Controller 52 may be of any convenient type. In the preferred embodiment, controller 52 is a microprocessor controlled device and, in the most preferred embodiment, is a programmable controller such as, for example, a programmable controller sold under the trademark Micon by Process Systems, Inc.

An inlet water temperature sensor 54 and an inlet water flow sensor 56 provide signals representing these parameters of the incoming hot water on conduit 16 to controller 52. A discharge water temperature sensor 58 provides a signal related to discharge water temperature on discharge conduit 26. An inlet steam pressure sensor 60 provides a signal representing the inlet steam pressure being fed to compressor 32 to controller 52. A discharge steam pressure sensor 62 provides a signal to controller 52 representing the pressure on the discharge side of compressor 32.

The amount of steam generated in flash tank 18 can be calculated by controller 52 based on the quantity of heat lost by the water between conduit 16 and discharge conduit 26. The heat content of water or steam is known as the enthalpy, generally represented as $h_f$ for water and $h_g$ for steam. To use a specific example, which should not be taken to limit the invention, it is assumed that the incoming hot water has a temperature of 195° F., the discharge water from flash tank 18 has a temperature of 177° F. and that the pressure in upper region 24 is maintained at about 7 PSIA (approximately 7.7 PSI vacuum). The enthalpy $h_f$ of water at 195° F. is 162.97 BTU/lbm. Thus, the total heat content of water entering flash tank 18 equals 162.97 BTU's times the flow rate in pounds. The discharge water and steam from flash tank 18 both leave at approximately 177° F. since this is the saturation temperature corresponding to 7 PSIA. The heat content $h_f$ of water at 177° F. is 144.91 BTU/lbm. Thus, each pound of water passing through flash tank 18 and giving up 18° F. in temperature also gives up approximately 18.06 BTU/lbm. The enthalpy $h_g$ of steam at 177° F. is 1137 BTU/lbm. From this, one can calculate that producing one pound of steam at 177° F. from water at 177° F. requires a change in enthalpy $h_{fg}$ of 992.1 BTU. Thus, using the temperature difference and incoming flow rate, an accurate calculation of generated steam can be made in controller 52. If hot water supply valve 14 is controlled to provide an incoming flow rate to flash tank 18 of, for example, 3,000 gallons per minute, a steam flow of approximately 27,000 pounds per hour will be produced.

Figure 2:
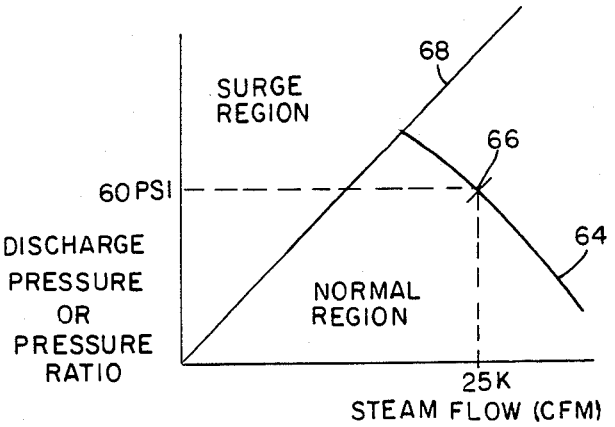
FIG. 2 is a plot of discharge pressure versus steam flow to which reference will be made in explaining a normal characteristic of a compressor and defining the onset of surges.

Referring now to FIG. 2, a typical operating characteristic curve 64 is shown for an arbitrarily selected compressor. The plane of discharge pressure versus steam flow is divided into an upper left region where surges can be expected and a lower right normal region where adequate flow and low enough pressure permits normal operation without surges. A normal operating point 66 is customarily selected at a substantial margin to the right and below a surge limit line 68. For example, a normal steam flow rate of 25,000 cubic feet per minute (at inlet temperature and pressure) may be selected for a compressor capable of producing a discharge pressure of 60 PSIG (assuming a constant inlet steam pressure). Under reduced flow conditions, the operating point of the compressor moves upward to the left along its operating characteristic and, if it reaches surge limit line 68, surges begin.

It will be noted from FIG. 2 that the two parameters defining the operating characteristic of the compressor can be derived from the measured parameters of FIG. 1. That is, steam flow either in pounds per unit time or cubic feed per unit time can be calculated from the measured temperature and flow of water in and out of flash tank 18. The discharge pressure or pressure ratio can be measured by pressure sensors sensing inlet and discharge steam pressures. Normal operating point 66 may be chosen at a steam flow which is, for example, about 20% above the flow at which surges may begin. For example, if the intersection of typical operating characteristic curve 64 and surge limit line 68 occurs at a steam flow of 20,000 CFM, normal operating point 66 at 25,000 CFM would suffice.

Returning now to FIG. 1, if steam flow or steam pressure departs significantly from the normal operating point, controller 52 adjusts hot water supply valve 14 and/or recycle valve 44 in a fashion which either increases the production of steam due to increased entry of hot water or increases the inlet steam flow to the compressor 32 by drawing off steam from conduit 38 and recycling it into flash tank 18. From an energy conservation standpoint, it may be desirable to increase incoming water flow to the maximum extent possible before beginning to recycle steam. Thus, a suitable control rule is as follows: (1) If steam flow decreases below a first threshold value less than the amount at normal operating point 66, controller 52 begins opening hot water supply valve 14 to restore steam flow to the normal operating point. If hot water supply valve 14 becomes fully opened and the steam flow continues to reduce to a second threshold lower than the first threshold, controller 52 begins opening recycle valve 44 to recycle flow to the compressor 32. (2) In an extreme case in which both hot water supply valve 14 and recycle valve 44 are both fully opened and steam flow continues to reduce beyond a third threshold, a system trip may be employed to avoid damage to compressor 32.

Without intending a limitation on the present invention, the following thresholds may be employed:

| STEAM FLOW CFM | ACTION |
|---|---|
| 25K | Normal operation |
| ≦22.5K | Begin opening hot water supply valve 14 |
| ≦21.5K (valve 14 fully open) | Begin opening recycle valve 44 |
| ≦21.0K | System trip |
| ≦20K | Damaging surges occur |

When inlet hot water conditions or steam outlet conditions return to normal, it would be clear that the remedial actions taken to avoid surges would be retraced.

The efficiency of a steam generating system such as shown in FIG. 1 can be assessed in a number of different ways. From an engineering standpoint, if the hot water employed as an input is essentially cost free such as might occur when the water is employed for cooling a companion industrial process, the thermal efficiency may be calculated on the basis of the ratio of the BTU's in the output steam to the BTU equivalent required to drive motor 34. A thermal efficiency of, for example, about 4 may be achieved.

The system may also be assessed from the standpoint of economic efficiency. In this case, exclusive of capital cost, the efficiency may be calculated as the ratio of the value of the steam generated to the cost of electricity for driving motor 34. Both the value of the steam and the cost of electricity are widely variable from location to location in the country and the economic efficiency cannot be stated here. Furthermore, if the incoming hot water is not cost free, this must also be factored into the economic efficiency.

In some industrial applications, a supply of low pressure steam from an alternate source may be available as well as steam generated by a flash tank in the manner previously described.

Figure 3:
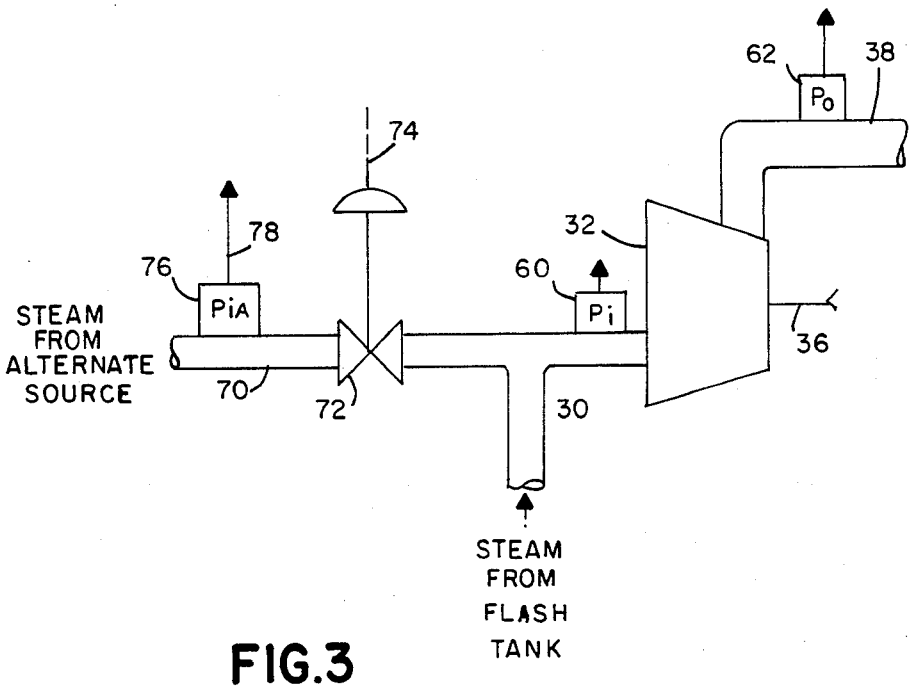
FIG. 3 is a simplified schematic diagram of a portion of a steam generation system according to a further embodiment of the invention.

Referring now to FIG. 3, such a combined system is shown in which steam from an alternate source (not shown) is applied on a conduit 70 to a throttling valve 72 which is controlled by a mechanical connection indicated by a dashed line 74 from controller 52 (see FIG. 1). A pressure sensor 76 senses the steam pressure from the alternate source and applies a signal on a line 78 to controller 52. If the flash tank and compressor 32 operate under substantially the same conditions as previously described with steam pressure in conduit 30 at about 7 PSIA, and if steam pressure in conduit 70 exceeds this value, then throttling valve 72 must be adjusted so that its pressure drop is such that its output pressure of steam added to conduit 30 is at substantially the same pressure as steam coming from the flash tank. For example, if the steam in conduit 70 is saturated steam at 30 PSIA, which corresponds to a steam temperature of 250° F., a pressure drop of about 23 PSIA must occur across throttling valve 72. Knowing the flow coefficient of throttling valve 72, its input pressure measured by pressure sensor 76 and its outlet pressure measured by inlet steam pressure sensor 60 and knowing the valve position established by mechanical connection 74, controller 52 can calculate the flow rate of steam through throttling valve 72 which is added to the steam from the flash tank. In this case, controller 52 controls inlet hot water flow and recycle flow in conjunction with throttling valve 74 to maintain a sufficient steam flow to avoid surges.

The control rule which one would use with the system of FIG. 3 depends on the relative economic value of steam from the alternate source versus the cost of generating the steam with the hot water entering flash tank 18. If both of these energy sources are otherwise waste, selection of the control rule is a matter of indifference. If a BTU of steam from the alternate source costs more than a BTU of steam from hot water developed in the flash tank, maximum use of the steam from the flash tank with minimum use of steam from the alternate source is indicated. That is, throttling valve 72 should remain fully closed as long as adequate steam flow can be generated by controlling hot water supply valve 14 feeding flash tank 18. When hot water supply valve 14 becomes fully opened, when the steam flow to compressor 32 falls below a threshold, throttling valve 72 should be opened to supply an augmenting amount of steam, with the amount being calculated from the known valve and pressure parameters of throttling valve 72 as previously described. If the sum of the steam available from the flash tank and from the alternate source is incapable of preventing the steam flow from decreasing to a second threshold, then recycle valve 44 is operated to begin recycling steam through desuperheater 48 in a manner previously described. As before, if a last threshold of flow is crossed, a system trip is generated. Alternatively, if the economic value of the hot water exceeds the value of the steam from an alternate source, the alternate source steam should be used to the limit of its availability before steam from the flash tank is consumed. That is, a control rule constructed for this economic reality reverses the positions of use of steam from the two sources. It would be clear to one skilled in the art, in the light of the present disclosure, that thresholds could be employed using pressure difference across the compressor rather than steam flow through it to control hot water, alternate source steam or recycle steam. Such use of pressure difference should be considered a part of the present invention.

It would also be clear to one skilled in the art that, instead of recycling steam from the discharge of compressor 32 to flash tank 18, it could be directly recycled to the inlet of compressor 32 without departing from the scope and spirit of the invention.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. In an apparatus for producing a high temperature, high pressure vapor from a lower vapor and liquid source including a flash tank having a hot liquid inlet, a vapor outlet and a liquid outlet; a compressor inlet connected to the vapor outlet of the flash tank; a control system for preventing the occurence of vapor surge within the compressor comprising:

an inlet liquid control valve positioned upstream from the flash tank hot liquid inlet;

a recycle control valve positioned in a conduit connecting the compressor discharge with the compressor inlet whereby vapor may be recirculated through the compressor to avoid surge; and, a programmable controller having programmed therein a surge limit line and receiving further operating inputs with respect to flash tank vapor flow and compressor discharge pressure; said controller providing control signals to the inlet and recycle control valves whereby said inlet valve is opened a preselected amount prior to causing the recycle valve to open.

2. The apparatus recited in claim 1 further comprising an alternate vapor source connected to said compressor inlet through a throttle valve, said throttle valve being controlled by said programmable controller whereby the sequence of valve opening includes the inlet valve, the throttle valve and the recycle valve.

3. In an apparatus for producing steam including a flash tank and a compressor; said flash tank including a hot water inlet, a steam outlet and a water discharge pipe and said compressor having an inlet connected to the steam outlet; a control system for preventing the occurrence of surge in said compressor during periods of low steam availability in the flash tank comprising:

a water inlet control valve connected upstream from the flash tank hot water inlet;

a recycle control valve positioned in a conduit connecting the compressor discharge with the compressor inlet whereby steam may be recirculated through the compressor to avoid the surge operating region;

a programmable controller having programmed therein a surge limit line defining a normal operating region and a surge operating region for the the compressor; the programmable controller being connected to the inlet valve and the recycle valve to provide valve control signals with a predetermined direction and sequence.

4. The apparatus acording to claim 3 wherein the programmable controller sequence includes:

opening the inlet valve;

opening the recycle valve;

closing the recycle valve; and, closing the inlet valve.

5. The apparatus according to claim 3 further comprising:

an alternate steam source; and, a throttle valve interconnecting the alternate steam source with the compressor inlet; the programmable controller being connected to the inlet valve, the recycle valve and the throttle valve to provide valve control signals with a predetermined direction and sequence.

6. The apparatus according to claim 5 wherein the programmable controller sequence includes:

opening the inlet valve;

opening the throttle valve;

opening the recycle valve;

closing the recycle valve;

closing the throttle valve; and, closing the inlet valve.

7. The apparatus recited in claim 3 further including inputs to the controller comprising:

water temperature in, water temperature out and inlet flow with respect to the flash tank to determine steam flow; and, inlet pressure and outlet pressure with respect to the compressor whereby it can be determined whether the compressor is operating in the normal region of the surge region.

8. The apparatus recited in claim 5 further including inputs to the controller comprising:

water temperature in, water temperature out and inlet flow with respect to the flash tank to determine flash tank steam flow; and pressure drop access the throttle valve and throttle valve position to determine alternate source steam flow; and combining flash tank steam flow and alternate source steam flow to determine a total steam flow; and, inlet pressure and outlet pressure with respect to the compressor whereby it can be determined whether the compressor is operating in the normal region or the surge region.

* * * * *